United States Patent [19]

Boeckmann et al.

[11] Patent Number: 4,704,842

[45] Date of Patent: Nov. 10, 1987

[54] METHOD AND APPARTUS FOR HANDLING RECLOSABLE WRAPPER SHEET MATERIAL

[75] Inventors: Hugo Boeckmann, Arlington Heights; Donald L. Van Erden, Wildwood, both of Ill.

[73] Assignee: Minigrip, Inc., Orangeburg, N.Y.

[21] Appl. No.: 787,119

[22] Filed: Oct. 15, 1985

[51] Int. Cl.[4] ..... B65B 9/06

[52] U.S. Cl. ..... 53/450; 53/568; 53/492; 53/550; 226/175; 226/179; 226/194; 493/410; 493/439

[58] Field of Search ..... 53/382, 492, 568, 551, 53/451, 266, 550, 450; 226/17, 175, 179, 190, 194, 199; 493/213, 244, 410, 436, 439, 440,

[56] References Cited

U.S. PATENT DOCUMENTS

| | | | |
|---|---|---|---|
| 1,508,673 | 9/1924 | Bingham | 226/175 |
| 1,972,555 | 9/1934 | Fear | 226/179 |
| 3,274,746 | 9/1966 | James et al. | 53/433 |
| 3,291,007 | 12/1966 | McDowell | 493/436 |
| 3,815,317 | 6/1974 | Toss | 53/451 |
| 4,260,116 | 4/1981 | Collin | 53/568 |
| 4,336,900 | 6/1982 | Pontoni | 226/199 |
| 4,355,494 | 10/1982 | Tilman | 53/451 |
| 4,449,351 | 5/1984 | Henderson | 53/382 |
| 4,589,145 | 5/1986 | Van Erden et al. | 53/410 |

*Primary Examiner*—Robert L. Spruill
*Assistant Examiner*—Donald R. Studebaker
*Attorney, Agent, or Firm*—Hill, Van Santen, Steadman & Simpson

[57] ABSTRACT

A system for handling zipper-equipped wrapper sheet material to be used in a form, fill, and seal machine for wrapping product enables the wrapper sheet to be drawn from a supply with a flap sheet portion overlying a panel sheet portion and subsequently disposing the flap sheet portion such that it is folded back away from the panel sheet portion to fully open up the wrapper sheet material. The folding over of the flap sheet portion brought about by apparatus which permits continuously flow of wrapper sheet to the form, fill, and seal machine at conventional machine high speed production rates. The system is made adjustable to handle zipper-equipped wrapper sheet material of various sizes. Devices are included to ensure proper tensioning of the line of wrapper sheet material passing to the form, fill, and seal machine.

22 Claims, 11 Drawing Figures

10
12
13
14
15
16
17
18
19
20
21
22
23
24
25
30
31
32
33
34
35
40
52
73
P
G
R
Z
W
F
B
II
II

METHOD AND APPARTUS FOR HANDLING RECLOSABLE WRAPPER SHEET MATERIAL

BACKGROUND OF THE INVENTION

The invention relates to a method and apparatus for packaging chunky product or articles, such as cheese, in reclosable zipper equipped packages and is more particularly concerned with a mechanical arrangement for feeding package wrapper material to a production line in a manner which prepares the wrapper material for reception of product in a reliable and expedient manner even at high production speeds.

Commonly assigned U.S. Ser. No. 547,392, now U.S. Pat. No. 4589145, filed Oct. 31, 1983, and entitled "Method Of Packaging, Packaging Material Therefor And Package", concerns the use of zipper equipped sheet material for producing a package in a conventional horizontal form, fill and seal machine such that the package can be reclosed after access has been gained to the product in the package. The special zipper equipped material comprises a wrapper sheet having a panel area for engagement with a face of the product, the sheet having portions which extend beyond the panel area and which are adapted to be wrapped into an envelope about the product by folding the sheet portions about the product edges and into engagement with the other face of the product. The free margins of the sheet portions are secured into a seam at the other face of the product and the wrapper sheet is dimensioned to provide for cross-seals at the ends of the envelope. The reclosable zipper means are provided on one of the sheet portions for closing together a web fold on that sheet portion. The web fold is adapted to be severed or ruptured to provide a package mouth opening for access to the product in the envelope, the mouth opening being reclosable by means of the zipper.

Plastic zipper bags equipped with cooperating reclosable fastener strips disposed along one edge of the bag forming a bag mouth have been known for a long time and are widely used both for commercially packaged products. Unfilled zipper bags have been supplied in large numbers for household use as sandwich bags and the like. However, Ser. No. 547,392 is understood to represent the first recognition of producing a package on a conventional horizontal form, fill, and seal machine wherein the package is equipped with zipper means so that the package can be reclosed after access has been gained to the product in the package.

A large volume of products of a relatively chunky, heavy type, such as bulk or sliced cheese food products, have been packaged in horizontal form, fill, and seal machines. The only type of packaging effected by these horizontal form, fill, and seal machines has involved wrapping of sheet packaging material about the product and sealing along a longitudinal line and then cross-sealing to complete the package. U.S. Pat. No. 3,274,746 is representative of previously existing conventional horizontal form, fill, and seal apparatus for packaging relatively heavy articles such as cheese in plastic film or the like. The method there disclosed consists of running the wrapper sheet in the form of a continuous strip along a horizontal packaging line wherein the wrapper sheet is wrapped about the product articles successively placed thereon in spaced units by folding the sheet from opposite sides onto the articles and sealing the opposite longitudinal margins of the sheets together. The sheet is, in effect, sealed into a tubular envelope about the articles and subsequently sealed across the envelope between the articles and separated into sealed individual article-containing package units. Such conventional horizontal form, fill, and seal apparatus is adapted to operate at relatively high production speeds in a continuous fashion.

The present invention concerns novel method and apparatus for bringing about a reliable and continuous feeding and opening of zipper equipped sheet material to be used for packaging products of a relatively chunky, heavy type, such as bulk or sliced cheese, so as to prepare the sheet material wrapper for reception of product and subsequent wrapping of the product in a conventional form, fill, and seal machine. The invention enables the conventional form, fill and seal machine to operate in its previous continuous, high-speed fashion even though the machine is now handling a very different zipper equipped wrapper material rather than conventional and intended continuous, flat wrapper sheet.

SUMMARY OF THE INVENTION

Continuous-length wrapper sheet material equipped with a zipper in the form of cooperating, engaged fastener strip profiles, such as disclosed in Ser. No. 547,392, is supplied via an inventive automated handling system to a form, fill, and seal machine. The inventive system serves to prepare the zipper-equipped wrapper sheet material for use in the form, fill, and seal machine by causing a sheet portion of the material initially overlying a panel sheet portion, which overlap is the result of the presence of the zipper on the wrapper sheet material, to be drawn back away from the panel sheet portion to open up the sheet material for packaging of product in the form, fill, and seal machine. The inventive system is adapted to handle the zipper-equipped wrapper sheet material in a continuous fashion, without interruption in movement of the material to the form, fill, and seal machine. The form, fill, and seal machine is able to operate at its intended high-speed production rate despite the unconventional use of zipper-equipped wrapper sheet material in the machine.

The continuous-length, zipper-equipped wrapper material is conducted about roller mechanisms under tension produced by operation of the form, fill, and seal machine. The material is guided along its flowpath by separate grooved platforms and circular grooves formed in the roller mechanisms, which grooves are adapted to receive the thickened portions of the wrapper sheet material due to the presence of zipper profiles on the material. The system includes a station which affords slack on the overlapping sheet portion of the material, and a station immediately following for causing the overlapping sheet to be folded over to now fully expose the panel sheet portion. The wrapper sheet material is conducted for introduction into the form, fill, and seal machine with the sheet material opened up fully exposing the panel sheet portion for reception of product in the form, fill, and seal machine.

The system is made adjustable to handle zipper-equipped wrapper sheet material of various sizes. The system is further adjustable to prevent slippage or mishandling due to excessive slack build-up in the flow of sheet material through the system.

Further objects, features, and advantages of the invention will become apparent from the following detailed description and drawings directed to the preferred embodiment.

DESCRIPTION OF THE PREFERRED EMBODIMENT

Figures 1, 2, 11:
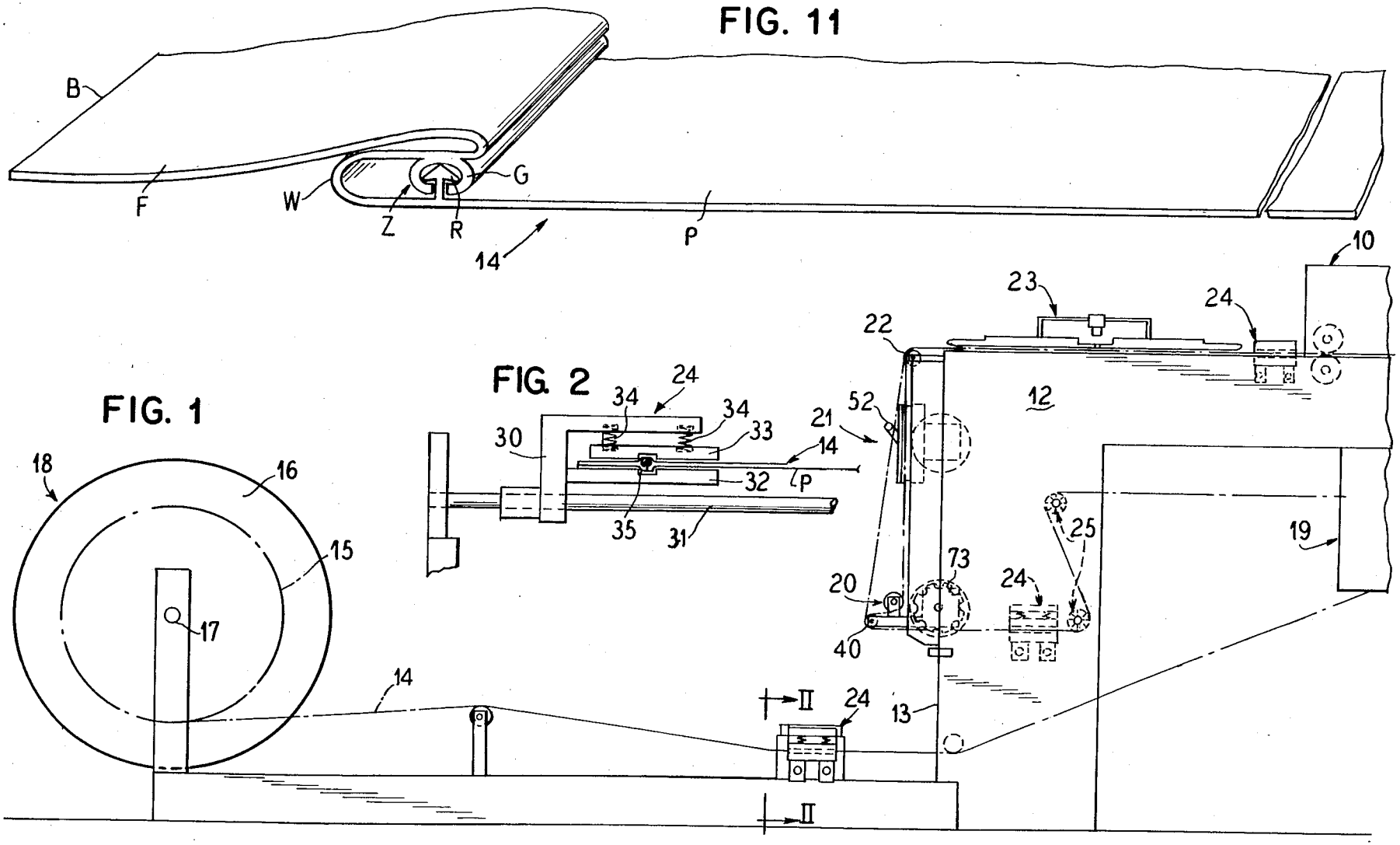
FIG. 1 is a schematic, side-elevational view of the zipper-equipped wrapper sheet material handling system for use with a form, fill, and seal machine constructed in accordance with the present invention.
FIG. 2 is a cross-sectional view taken along the lines II—II of FIG. 1.
FIG. 11 is a perspective view of the zipper-equipped sheet wrapper material used in the inventive system disposed as intended for presentation into the form, fill, and seal machine.

FIG. 1 illustrates an automated system in accordance with the invention utilizing a zipper-equipped plastic wrapper sheet for packaging product or articles, such as cheese, in a conventional horizontal form, fill, and seal machine 10. The form, fill, and seal device may be of a type such as disclosed in U.S. Pat. No. 3,274,746 and includes a suitable drive mechanism, such as indicated by nip rollers 11, for drawing the wrapper sheet into the form, fill, and seal machine 10 and conducting the wrapper sheet through the machine.. The form, fill, and seal machine 10 is horizontally arranged on a table 12 having a vertical side 13 along which the wrapper sheet material is conducted for delivery to the machine 10.

The wrapper sheet material 14 is constructed in a manner disclosed in Ser. No. 547,392. FIG. 11 illustrates the manner in which the wrapper sheet material 14 is disposed upon entry into the form, fill, and seal machine 10 for packaging product resulting in individual package units of a type which can be reclosed after access has been gained to the product in the package. Initially, however, the wrapper sheet 14 to be supplied to the machine 10 is arranged differently than the disposition shown in FIG. 11. The wrapper sheet material 14 is supplied in the form of a continuous, elongate strip wound into a roll 15. The roll 15 is disposed in a spool 16 rotatable on a shaft 17 in an unwinding station 18. The shaft 17 is preferably fitted with a built-in clutch for controlling tension in the wrapper sheet as it is unwound from the roll 15.

With reference to FIG. 11, the wrapper material 14 has a continuous elongate panel sheet portion P onto which product is placed in the form, fill, and seal machine 10. The panel sheet portion P has a free edge at its bottom end in the widthwise direction of the sheet material and is folded over at its upper end in a web fold W whereby a flap sheet portion F is defined. The flap sheet portion F, in its original disposition as unwound from the roll 15, overlies the panel sheet portion, but only partially since the widthwise extent of the flap sheet portion is less than that of the panel sheet portion. A reclosable zipper means Z in the form of a pair of cooperatively interlock fastener profile strips R and G extend longitudinally of the wrapper sheet 14 and are respectively disposed on the facing surfaces of the panel and flap sheet portions between the web fold W and the bottom free edge B of the flap sheet portion. The interlock fastener profile strips R and G preferably comprise a pair of complimentary extruded plastic rib and groove members for forming a reclosable elastically deformable plastic zipper fastener package of a type such as disclosed in U.S. Pat. Nos. 3,198,228; 3,780,781; 3,886,633; and 4,372,793.

The inventive system, as shown in FIG. 1, is concerned with conducting the wrapper sheet 14 from the spool 16 in the unwinding station 18 longitudinally to a suitable printing station 19, if desired, and then upwards along the vertical side edge 13 of the machine table through a station 20 for commencing unfolding of the flap sheet portion F off of the panel sheet portion P of the wrapper sheet followed by a station 21 positioning the flap sheet portion of the wrapper sheet 14 relative to the panel sheet portion in the disposition as shown in FIG. 11. From station 21, the wrapper sheet 14 is conducted about a guide roll 22 so that the wrapper sheet is now conducted horizontally along the top of the machine table 12, in the open wrapper disposition as shown in FIG. 11, through a suitable cleaning station 23 (such as an apparatus which directs air under pressure onto the exposed surfaces of the wrapper sheet portions for dust removal) and on into the form, fill, and seal machine 10 for the wrapping of product in the zipper-equipped wrapper sheet material as described in Ser. No. 547,392. The inventive system includes the use of guide platforms 24 disposed along the path of movement of the wrapper sheet 14 for simultaneously supporting and guiding the flow of wrapper sheet. The inventive system further includes one or more guide rolls 25 specially constructed to afford adjustable diameters to control slack in the wrapper sheet movement.

The guide platforms 24 are constructed as shown in FIG. 2. A bracket 30 is mounted on a support 31 extending laterally relative to the longitudinal flow of wrapper sheet in the inventive system. A pair of plates 32 and 33 are mounted on the bracket between which the wrapper sheet 14 passes. The upper plate 33 is resiliently biased by springs 34 toward the bottom plate 32 to allow easy threading and to accommodate variations in sheet thicknesses while maintaining a positive, resilient grip on the wrapper sheet. In order to maintain alignment in the movement of wrapper sheet, the upper and lower facing surfaces of the plates 32 and 33 are formed with longitudinal extending facing grooves 35 for receiving therethrough the relatively raised or thickened zipper means portions Z of the wrapper sheet.

Figure 3:
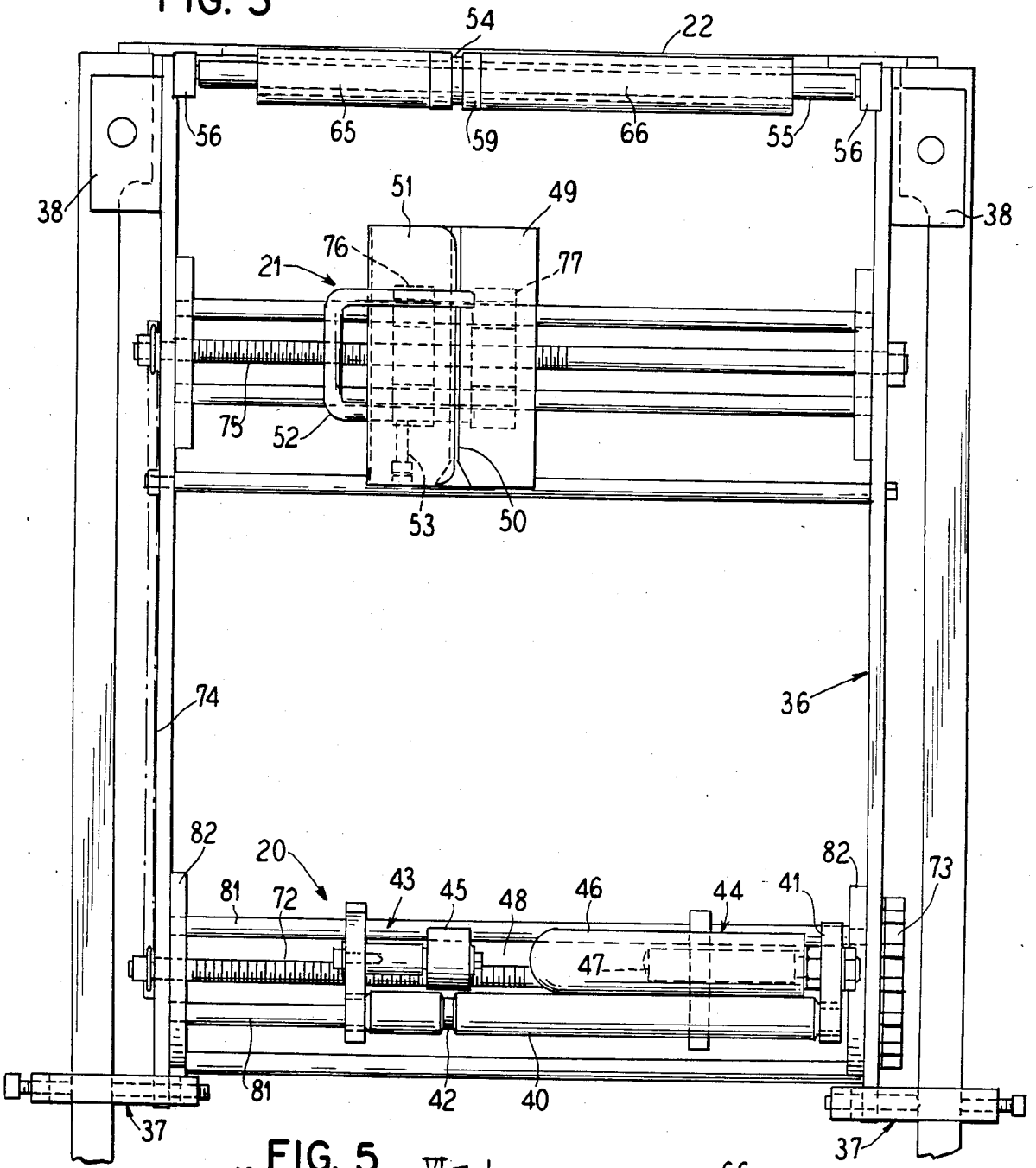
FIG. 3 is a front elevational view of that portion of the inventive system containing the bending station and flap fold over station.

With respect to FIG. 3 a unit bracket 36 may be provided for supporting the stations 20 and 21 and guide roll 22. The unit bracket 36 is removably mounted to the vertical side of the machine table 12. The bracket includes suitable mounting flanges, such as anchor clamps 37 and mounting blocks 38, for affixing to the table 12. The features contained on the bracket 36 are thus portable and may be readily and easily put in place on a support table for a form, fill, and seal machine to convert conventional form, fill, and seal machine operation to one in which zipper-equipped wrapping sheet is used to make individual packages.

Stations 20 and 21 together serve to cause the flap sheet portion F to become folded over from the panel sheet portion P (ie., the disposition as shown in FIG. 11) as the wrapper sheet is continuously drawn from the winding station 18 into the machine 10, even at the machine's conventional high rates of production speed for plain wrapper sheet. The wrapper sheet 14 is conducted in a substantially vertical plane of movement between stations 20 and 21 and the guide roll 22, as shown in FIG. 4.

Figure 4:
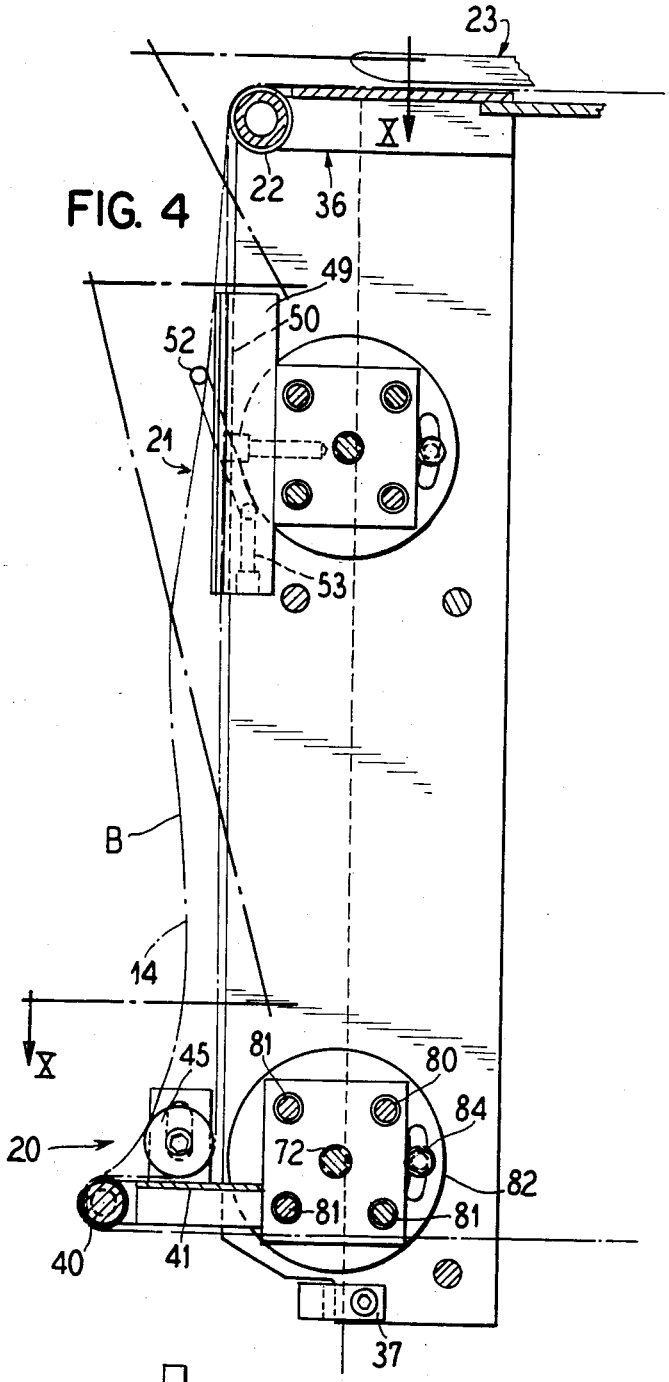
FIG. 4 is a cross-sectional view of the system portion of FIG. 3 in operation.

At station 20, with reference to FIGS. 3 and 4, the wrapper sheet passes about a bending guide roll 40 supported for rotation on a carrier platform 41. The rotational axis of the guide roll 40 is spaced apart from the plane of movement of the sheet between stations 20 and 21. The guide roll 40 is formed with a circular groove 42 of reduced diameter relative to the remainder of the roll for receiving the relatively raised zipper means portions of the wrapper sheet. As the wrapper sheet passes from the guide roll 40 in a direction substantially perpendicular to the plane of movement of the wrapper sheet between stations 20 and 21, the wrapper sheet is threaded beneath and around a pair of guides 43 and 44, spaced apart from one another but substantially coaxial.

The guides 43 and 44 are mounted from opposed sides of the platform 41. The first guide 43 comprises a roll 45 sized to only partially overlie the flap sheet portion, preferably adjacent the zipper means Z on the wrapper sheet. The guide 44 comprises a circular bar 46, which may be mounted for rotation on a stub shaft 47. The overlies the panel sheet portion P of the wrapper sheet short of the free edge B of the flap sheet portion. There is a gap 48 between the facing ends of the guides 43 and 44 beneath which a substantial portion of the flap sheet adjacent its bottom free edge B passes. This gap area 48, due to the absence of support on the flap sheet portion F adjacent the bottom edge thereof, allows for slack in the flap sheet portion such that the bottom edge of the flap sheet portion is raised from the panel sheet portion P into this gap area 48 as the flap sheet portion commences being folded back off of the panel sheet portion.

With reference to FIGS. 3 and 4, the wrapper sheet exiting the station 20 is drawn in a substantially vertical direction to station 21. Station 21 comprises a platform 49 which is disposed on the unit bracket 36 to receive the flow of wrapper sheet thereover. The platform 49 may be sized, as shown in the drawing, such that it principally underlies the upper portion of the wrapper sheet adjacent the zipper means Z and is provided with a longitudinally extending groove recess 50 for receiving therethrough the portion of the zipper means Z protruding from the bottom surface of the wrapper sheet. A guide flange 51 is mounted at the outer surface of the platform 49 and extends inwardly so as to be overlying the platform such that the web fold area W of the wrapper sheet passes between the guide flange 51 and facing surface of the platform 49. A relatively larger guide flange 52, generally in the form of a U-shaped bar, is mounted at the outer end of the platform 49 such that one of the legs of the bar 52 fits into a cooperating bore formed in the platform 49 and the relative disposition of the exterior, free leg of the bar 52 can be adjustably set by pivoting the bar in the platform bore and locking the position of the bar as desired by a screw means which includes a threaded channel 53 intersecting with the bore in the platform 49 receiving the leg of the bar 52. The outer free leg of the bar 52 is disposed to overlie the guide flange 51 for supporting therebetween folded over or upturned flap sheet portion F. Thus, wrapper sheet 14 exiting from the second station 21 is disposed in the flap-open condition necessary for proper handling in the form, fill, and seal machine 10.

From the station 21, the wrapper sheet 14 (now in its opened disposition as illustrated in FIG. 11) is drawn vertically to the top of the unit bracket 36 adjacent the top of the machine table 12 and conducted about the guide roll 22 for horizontally directed movement along the top of the table 12 and into the form, fill, and seal machine 10. The guide roll 22 includes a circular groove 54 of reduced diameter relative to the remainder of the guide roll surface to guidingly receive therethrough the relatively thickened portion of the wrapper sheet 14 along the line of the zipper means Z facing from the bottom surface of the wrapper sheet. The position of the groove 54 on the guide roll 22 is aligned with the guide groove 42 and guide channel 50 in the stations 20 and 21 respectively with respect to the flow path of the wrapper sheet in the inventive system since the disposition of the zipper means Z on the wrapper sheet does not shift in the flow path movement of the sheet despite the folding over handling of the flap sheet portion F.

Figure 5:
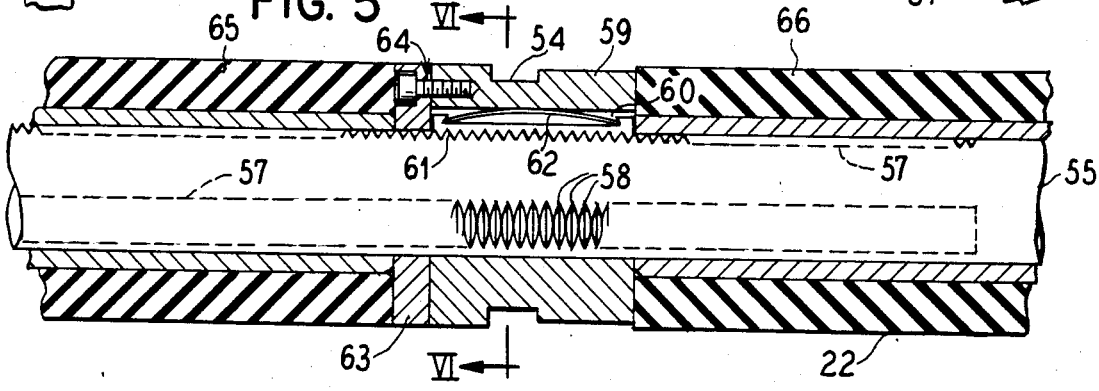
FIG. 5 is a fragmentary, cross-sectional view of a delivery roller in the system having a cammed adjustable guide groove section.
Figure 6:
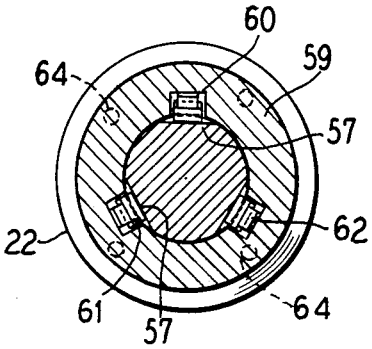
FIG. 6 is a cross-sectional view taken along the lines VI—VI of FIG. 5.

The guide roll 22 comprises a rotatable shaft 55 journaled at opposed ends in side mountings 56 formed on the unit bracket 36. In accordance with the preferred embodiment, the guide roll 22 is of a special construction suitable for a guide roll device in other environments in which zipper-equipped wrapper sheet material is being conducting along a flow path and it is possible that various sizes of such material may be conducted along that flow path whereby the relative location of the zipper means Z on the material could change vis-a-vis the guide roll surface. The present inventive system is arranged to accommodate wrapper sheet material of various sizes and hence changes in the relative position of the zipper means Z in the wrapper sheet material as the sheet material moves along its flow path. With reference to FIGS. 5 and 6, the shaft 55 for the guide roll 52 is formed with three separate longitudinally extending series 57 of upstanding, laterally extending teeth 58, the teeth series 57 preferably being equidistantly spaced apart from one another circumferentially about the shaft 55. The groove 54 is formed in a circular solid section 59 having a hollow interior for receiving the shaft 55 therethrough. Three longitudinally directed recesses 60 directed directly outward in the solid section 59 are formed in the solid section to overlie the teeth series 57 on the shaft 55. A resilient lock device in the form of a longitudinally directed toothed member 61 and a spring 62 is disposed between the radially inward facing bottom surface of the solid section 59 at each of the grooves 60 and the teeth 58. The teeth of the member 61 interengage with the shaft teeth 58 and the spring 62 is disposed between the member 61 and the solid section 59 to provide a radially directed resilient force, causing the groove-containing solid section 59 to be resiliently locked against longitudinal shifting along the length of the shaft 55. Applying longitudinally directed force to the solid section 59 causes the teeth of the member 61 to cam over the shaft teeth 58 in stepwise fashion against the bias of the spring 62 such that the solid section 59 and its groove 54 can be adjustably positioned along the axis of the shaft 55 to properly locate the groove 54 for zipper-equipped sheet material of different sizes. To ensure locking in of the solid section 59 along the lengths of the teeth series 57, a further circular solid section 63 is provided to encompass the shaft 55 and fixedly attach to the solid section 59, such as by screw means 64. This locking piece 63 is formed with a series of toothed surfaces for engaging with the teeth 58 on the shaft. The teeth 58 and the interengaging teeth on the locking section 63 are preferably in the form of a screw thread relationship, such that the section 63, when released from attachment to the solid section 59, such as by unscrewing the screw means 64, can be rotated about the shaft 55 to adjust for new longitudinal positioning of the solid section 59. The remaining outer circumferential surface of the guide roll 22 is formed by separate cylindrical pieces 65 and 66 which fit concentrically about the shaft 55 and are cut to appropriate lengthwise size. The separate cylinder pieces 65 and 66 are preferably made of or coated with rubber or sponge material to provide tension upon the wrapper sheet being conducted abou the guide roll 2 and hence serve to take up slack and eliminate wrinkles.

Figure 10:
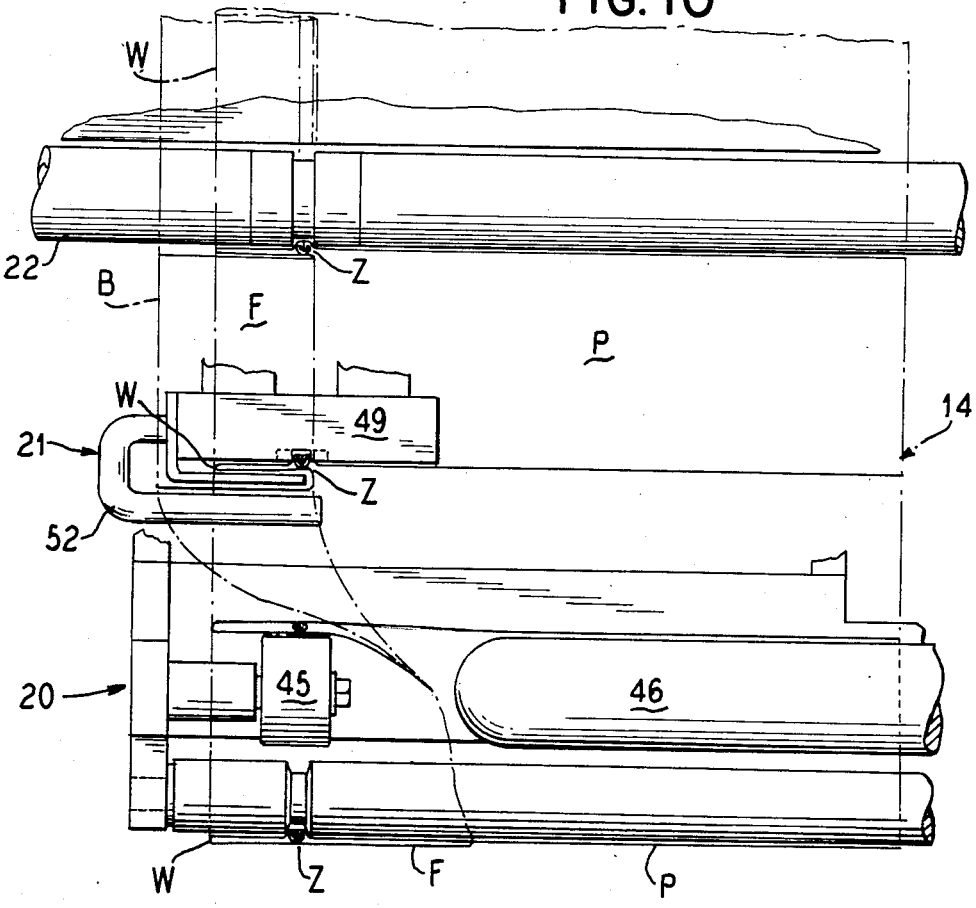
FIG. 10 is a cross-sectional view taken along the lines X—X of FIG. 4.

The manner in which the wrapper sheet 14 is conducted through the stations 20 and 21 and guide roll 22 of the unit bracket 36 is illustrated in FIG. 10. As this FIGURE shows, the wrapper sheet upon entry into the upstream station 20, is disposed such that the flap sheet portion F overlies the panel sheet portion; however, the wrapper sheet upon exiting the downstream station 21 for passage about the guide roll 22 is disposed such that the flap sheet portion F is folded over the web fold W of the wrapper sheet 14 to fully expose the upper facing surface of the panel sheet portion P beneath the zipper means Z as well as fully expose the undersurface of the flap sheet portion F. Disposed in this position, as shown in FIG. 11, the wrapper sheet 14 can be handled in the form, fill, and seal machine 10 for wrapping product in zipper-equipped wrapper material.

Figure 7:
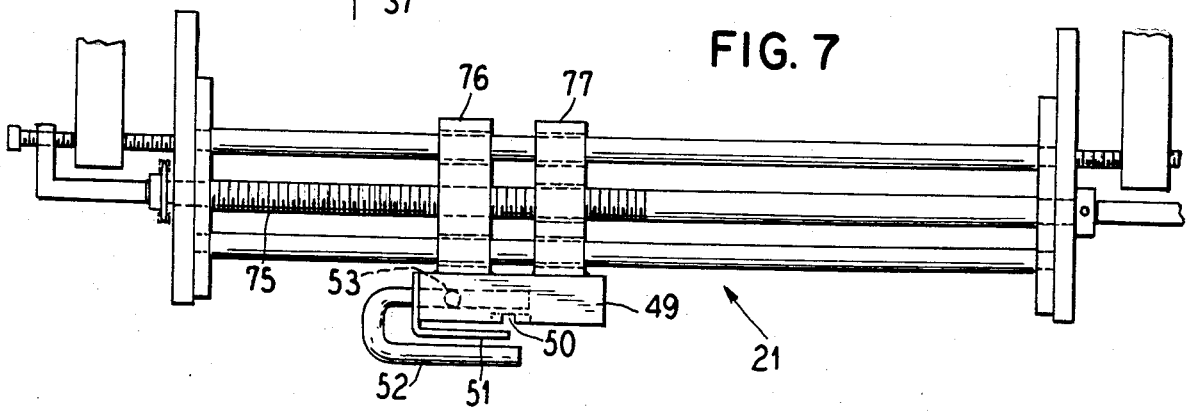
FIG. 7 is a top elevational view of the flap fold over station of the system.
Figure 8:
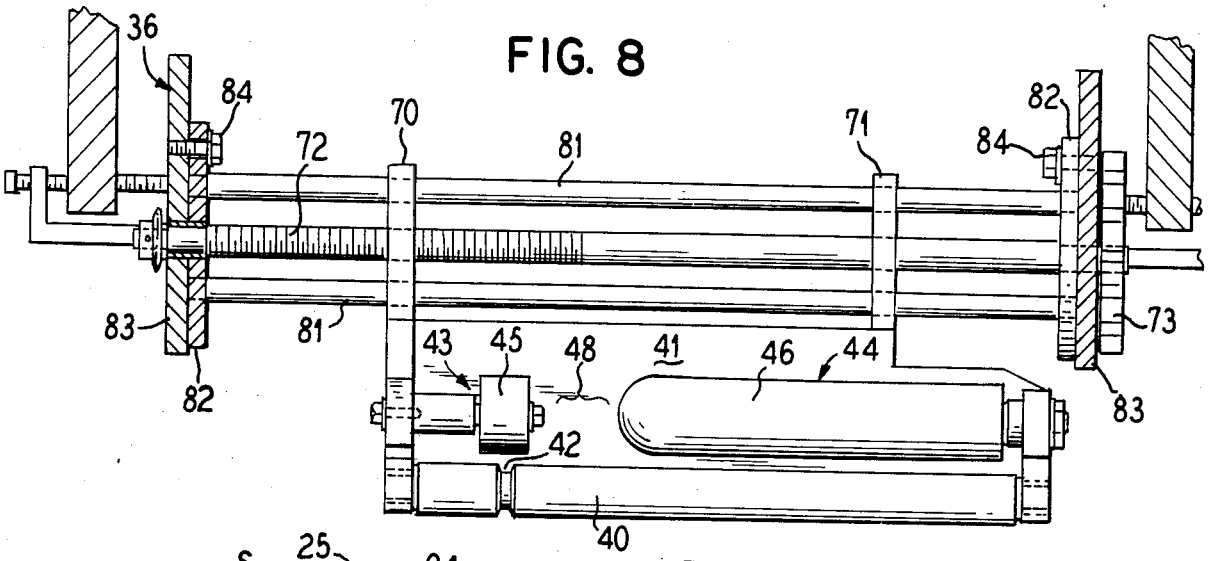
FIG. 8 is a top elevational view of the bending station of the system.

With reference to FIGS. 3, 7, and 8, the widthwise disposition of the guide channel 50 in the station 21 and the guide groove 42 on the roll 40 in station 20, as well as the disposition of the gap 48 for exposing a substantial portion of the flap sheet F adjacent its bottom edge B, is adjustable to allow for use in the system of zipper-equipped wrapper material of various sizes and hence varying relative locations of zipper means Z along the flow path of the wrapper sheet to the machine 10. In station 20, the platform 41 is supported on a pair of threaded brackets 70 and 71, as shown in FIG. 8 . A rotary screw shaft 72 is journaled between the sides of the unit bracket 36 and the threaded portions of the brackets 70 and 71 are supported for movement along this screw shaft. A portion of the screw shaft 72 extends beyond the journal at one end of the shaft and a hand wheel 73 is fitted on this extended end of the screw shaft 72 for rotating the screw shaft. The other end of the screw shaft 72 also extends outwardly beyond its journal this outer end of the screw shaft 72 serves as one end of a drive transmission means 74, such as a gear and chain type, connected with an outer free end of a similar, rotary screw shaft 75 disposed in station 21. The platform 49 of station 21 is mounted on threaded brackets 76 and 77. The rotary screw shaft 75 cooperates with the threaded portions of the brackets 76 and 77 such that rotational movement of the screw shaft 75 serves to adjustably position the platform 49 in a widthwise direction relative to the longitudinal flow of wrapper sheet. As a result of the drive transmission 74 interconnecting the rotary screw shafts 72 and 75, a single hand wheel 73 enables the operator to simultaneously adjust the position of the platforms 41 and 49 in the stations 20 and 21.

The brackets 70 and 71 in station 20 and the brackets 76 and 77 in station 21 are disposed for adjustable positioning relative to the vertical plane of movement of wrapper sheet along the unit bracket 36 in a similar manner such that this device need only be described with respect to one of the stations. With respect to station 20, the brackets 70 and 71 are formed with laterally extending holes 80 spaced about their outer portions. Extending through these holes 80 laterally across the unit bracket 36 is a respective series of bars 81 fixed at their opposed lateral ends in disks 82 journaled about the screw shaft 72. The disks 82 are disposed for rotation about the screw shaft 72 immediately adjacent respective side plates 83 of the unit bracket 36. As shown in FIGS. 4 and 8, cooperating arc-shaped openings are formed in the disks 82 for receiving the threaded portions of bolts 84 which may be tightened into threaded holes formed on the side plates 83. Accordingly, the bolts 84 may be loosened and the disks 82 rotated about the screw shaft 72 to properly align the platform 41 for substantially smooth, linear movement of wrapper sheet thereover. When the platform 41 has been properly aligned for the flow of wrapper sheet, the bolts 84 are tightened into the side plates 83.

Figure 9:
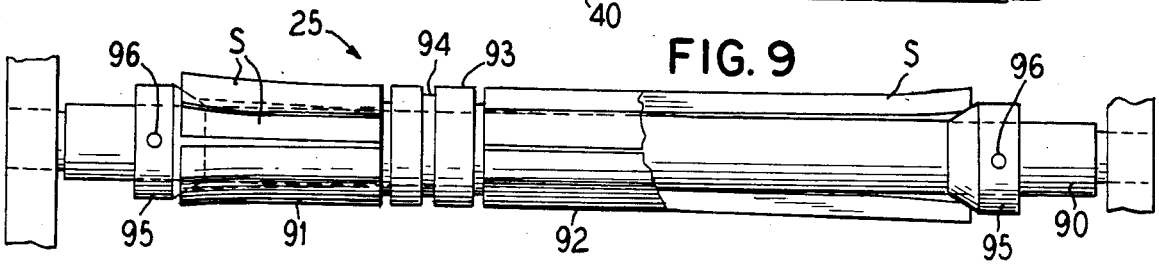
FIG. 9 is a front elevational view of a guide roll in the system formed with a splined surface and cooperating wedged end supports for adjusting tension on the flow of sheet wrapper material in the system.

In the event of undesirable slack build-up in the flow of wrapper sheet through the system, it is further feature of this invention that the guide rolls 25 be of a special construction as shown in FIG. 9. This special guide roll construction is not limited to the environment of this invention and is contemplated to also be suitable for properly tensioning any elongate longitudinally directed flow of film about guide rolls, especially lengthy movement of zipper-equipped sheet material. The guide roll 25 comprises a shaft 90 journaled for a rotation at opposed ends. A pair of splined sections 91 and 92 are disposed circumferentially about the shaft 90 on opposed lateral sides of a solid cylindrical section 93 concentric about the shaft. The solid section 93 is loosely mounted on the shaft 90 and contains a circular groove 94 of reduced diameter relative to the substantial remainder of the guide roll 25 for receiving in guiding fashion the thickened portion of the zipper means Z on the wrapper sheet 14. Each of the splined sections 91 and 92 comprises a series of longitudinally extending, juxtaposed splines S circumferentially disposed about the shaft 90 and connected together with one another at an inner longitudinal end adjacent the solid section 93. The splines S are preferably made of plastic and may be molded so as to the connected together at this inner longitudinal end. The opposed outer longitudinal ends of each of the splined sections 91 and 92 have the splines S separated from one another. A pair of cams 95 are concentric about the shaft 90 and provided with suitable locking means, such as set screws 96, to enable adjustable longitudinal positioning of the cams 95 along the length of the shaft. Each of the cams 95 has a circular wedge-shaped surface for fitting between the shaft and the outer longitudinal end of a respective splined section 91 or 92. Thus, inward or outward longitudinal movement of the cam 95 relative to the outer longitudinal end of the splined section serves to expand or contract the outer diameter formed by the free ends of the splines S on that splined section, due to the camming action of the wedge-shaped surface. Expanding this diameter serves to take up slack, particularly edge slack which may develop on zipper-equipped sheet material in the flow of wrapper sheet or film by further tensioning the sheet material line. The relative longitudinal position of the solid section 93 and its circular groove 94 along the length of the shaft 90 is adjustable as a consequence of the adjustable positioning of the cams 95.

Although various minor modifications may be suggested by those versed in the art, it should be understood there are to be embodied within the scope of the patent warranted hereon all such modifications as reasonably and properly come within the scope of this contribution to the art.

We claim as our invention: .

1. A method of longitudinally conducting a continuous elongated wrapper sheet to a form, fill, and seal machine taking in said wrapper sheet, said wrapper sheet having a panel sheet portion having one free end for receiving product thereon in said machine, a flap sheet portion formed by a web fold at the other end of said panel sheet portion partially overlying said panel sheet portion width, and a reclosable zipper means in the form of a pair of cooperatively interlocked fastener profile strips extending longitudinally of said wrapper sheet and respectively disposed on facing surfaces of said panel and flap sheet portions between said web fold and a free edge of said flap sheet portion, said method comprising:

providing spaced apart first and second guides at a first station wherein said first guide overlies said flap sheet portion from said web fold to beyond said zipper means but short of said free edge thereof and said second guide overlies said panel sheet portion from said free edge thereof to short of said free edge of said flap sheet portion, turning said flap sheet portion off of said panel sheet portion such that said free edge of said flap sheet portion is raised from said panel sheet portion in a gap betwen said first and second guides, folding over said flap sheet portion to expose said facing surface of said panel sheet portion previously underlying said flap sheet portion beyond said zipper means, and passing said folded over flap sheet portion beneath a third guide at a second station downstream of said first station in the direction of conduction of said wrapper sheet to said machine.

2. The method of claim 1, further comprising:

passing said wrapper sheet into said machine with said flap sheet portion folded over such that said free edge is directed substantially opposed from said free end.

3. The method of claim 1, further comprising:

passing said wrapper sheet about a fourth guide upstream of said first station, said fourth guide being spaced apart from the plane of movement of said wrapper sheet between said first and second stations.

4. Apparatus for longitudinally conducting a continuous elongated wrapper sheet to a form, fill, and seal mahine taking in said wrapper sheet, said wrapper sheet having a panel sheet portion having one free end for receiving product thereon in said machine, a flap sheet portion formed by a web fold at the other end of said panel sheet portion partially overlying said panel sheet portion width, and a reclosable zipper means in the form of a pair of cooperatively interlocked fastener profile strips extending longitudinally of said wrapper sheet and respectively disposed on facing surfaces of said panel and flap sheet portions between said web fold and a free edge of said flap sheet portion, said apparatus comprising:

a first station having first and second guides separated from one another by a gap therebetween, said first guide disposed to overlie said flap sheet portion from said web fold to adjacent said zipper means short of said free edge thereof and said second guide disposed to overlie said panel sheet portion from saisd free end thereof to short of said free edge of said flap sheet portion and a second station, downstream of said first station in the direction of movement of said wrapper sheet, having a third guide disposed to overlie said web fold, whereby said wrapper sheet is passed through said first and second stations such that said flap sheet portions turns off of said panel sheet portion and said free edge is raised into said gap between said first and second guides in said first station and said flap sheet portion is folded over to expose facing surface of said panel sheet portion previously underlying said flap sheet portion in said second station.

5. The apparatus of claim 4, wherein said first and second guides are generally circular and substantially coaxial with one another.

6. The apparatus of claim 4, wherein said first guide overlies said flap sheet portion to beyond said zipper means.

7. The apparatus of claim 4, wherein said first guide is a roll.

8. The apparatus of claim 4, further comprising guide rolls about which said wrapper sheet is passed, said guide rolls each having a circular groove of reduced diameter relative to a substantial remainder of said guide roll for receiving said zipper means therethrough.

9. The apparatus of claim 8, wherein at least one of said guide rolls comprises a shaft, a pair of splined sections on opposed sides of a solid section containing said groove mounted on said shaft, each said splined section comprising a series of longitudinally extending, juxtaposed splines circumferentially disposed about said shaft and connected together with one another at an inner longitudinal end adjacent said solid section and separated from one another at the opposed outer longitudinal end, and a pair of cams, adjustably mounted on said shaft, each having a circular wedge-shaped surface for fitting between said shaft and said splines and respectively disposed at said outer longitudinal ends of said splined sections.

10. The apparatus of claim 8, wherein at least one of said guide rolls comprises a shaft having at least one longitudinally directed series of upstanding, laterally extending teeth, a solid section disposed about said shaft containing said groove and having a radially inward facing bottom surface, and a resilient lock means disposed between said bottom surface and said teeth for disposing said solid section for adjustable mounting along the longitudinal length of said shaft.

11. The apparatus of claim 10, wherein said lock means comprises a longitudinally directed member toothed on its radially inward facing side for interengagement with said teeth on said shaft and a spring means disposed the radially outward facing side of said member and said solid section for biasing radially outward against said bottom surface.

12. The apparatus of claim 4, wherein said first station further comprises a guide roll, disposed upstream of said first and second guides in the direction of movement of said wrapper sheet and spaced apart from the plane of movement of said wrapper sheet between said first and second stations, for directing movement of said wrapper sheet to said first and second guides in a direction substantially perpendicular to the plane of movement of said wrapper sheet between said first and second stations.

13. The apparatus of claim 12, wherein the plane of movement of said wrapper sheet between said first and second stations is substantially vertical.

14. The apparatus of claim 4, wherein said first station is supported on a platform which is disposed for adjustable positioning along a screw shaft having a rotational axis extending in the width direction of said wrapper sheet.

15. The apparatus of claim 14, wherein said second station is supported on a platform which is disposed for adjustable positioning along a screw shaft having a rotational axis extending in the width direction of said wrapper sheet.

16. The apparatus of claim 15, wherein a drive transmission connects the rotational movements of said first and second station screw shafts with one another.

17. The apparatus of claim 4, wherein said second station is supported on a platform which is disposed for adjustable positioning along a screw shaft having a rotational axis extending in the width direction of said wrapper sheet.

18. The apparatus of claim 4, further comprising at least one guide platform comprising a pair of upper and lower facing surfaces each formed with a longitudinally extending groove for receiving therein said zipper means, said wrapper sheet passing between said facing surfaces, and one of said surfaces bieng spring biased toward the other surface.

19. A portable assembly for use in a system longitduinally conducting continuous elongated wrapper sheet to a form, fill, and seal machine taking in said wrapper sheet, said wrapper sheet having a panel sheet portion having one free end for receiving product thereon in said machine, a flap sheet portion formed by a web fold at the other end of said panel sheet portion partially overlying said panel sheet portion width, and a reclosable zipper means in the form of a pair of cooperatively interlocked fastener profile strips extending longitudinally of said wrapper sheet and respectively disposed on facing surfaces of said panel and flap sheet portions between said web fold and a free edge of said flap sheet portion, said assembly comprising a bracket means for attaching to a vertical side edge of a table containing said form, fill, and seal machine, said bracket containing a first station having first and second guides separated from one another by a gap therebetween, said first guide disposed to overlie said flap sheet portion from said web fold to beyond said zipper means but short of said free edge thereof and said second guide disposed to overlie said panel sheet portion from said free end thereof to short of said free edge of said flap sheet portion, and, a second station, downstream of said first station in the direction of movement of said wrapper sheet, having a third guide disposed to overlie said web fold, whereby said wrapper sheet is passed through said first and second stations such that said flap sheet portions turns off of said panel sheet portion and said free edge is raised into said gap between said first and second guides in said first station and said flap sheet portion is folded over to expose facing surface of said panel sheet portion previously underlying said flap sheet portion in said second station.

20. The assembly of claim 19, wherein said first station further comprises a guide roll, disposed upstream of said first and second guides in the direction of movement of said wrapper sheet and spaced apart from the plane of movement of said wrapper sheet between said first and second stations, for directing movement of said wrapper sheet to said first and second guides in a direction substantially perpendicular to the plane of movement of said wrapper sheet between said first and second stations.

21. The assembly of claim 19, wherein said first and second stations are respectively disposed on first and second platforms, each of which is disposed for adjustable positioning along a screw shaft having a rotational axis extending in the width direction of said wrapper sheet, and a drive transmission connects the rotational movements of said first and second screw shafts with one another.

22. A guide roll for receiving thereover a continuous elongate film having upper and lowersheet portions and a reclosable zipper means in the form of a pair of cooperatively interlocked fastener profile strips extending longitudinally of said wrapper sheet and respectively disposed on facing surfaces of said sheet portions, comprising a shaft having at least one longitudinally directed series of upstanding, laterally extending teeth, a solid section disposed about said shaft having an outer surface containing a groove for receiving said zipper means profile strips therein and having a radially inward facing bottom surface containing at least one recess extending longitudinally through said solid section, and a resilient lock means disposed in said recess for supporting said solid section on said shaft, said lock means having a longitudinally directed member toothed on its radially inward facing side for interengagement with said teeth on said shaft and a spring means disposed between the radially outward facing side of said member and said solid section for biasing radially outward against said bottom surface permitting adjustable mounting of said solid section along the longitudinal length of said shaft.

* * * * *